US006119676A

United States Patent [19]

Greenland

[11] Patent Number: 6,119,676

[45] Date of Patent: Sep. 19, 2000

[54] SAW HAVING MOVABLE TABLE AND SAW BLADE

[76] Inventor: Darrell Greenland, 1650 Tenth St., Santa Monica, Calif. 90404

[21] Appl. No.: 09/044,590

[22] Filed: Mar. 19, 1998

[51] Int. Cl.[7] ..... B28D 7/04

[52] U.S. Cl. ..... 125/35; 451/342

[58] Field of Search ..... 125/12, 35, 13.03, 125/14, 16.03, 17; 451/360, 342, 361, 340, 364, 343, 392, 414, 460; 83/733, 435.23, 437.5, 435.12, 487, 435.13, 435.14; 269/73; 157/13

[56] References Cited

U.S. PATENT DOCUMENTS

| | | |
|---|---|---|
| 2,241,142 | 5/1941 | Kvalheim . |
| 3,090,615 | 5/1963 | May . |
| 3,807,095 | 4/1974 | Harding . |
| 3,844,269 | 10/1974 | Rater . |
| 4,105,012 | 8/1978 | Hini et al. . |
| 4,393,450 | 7/1983 | Jerard . |
| 4,940,038 | 7/1990 | O'Keefe . |
| 4,976,251 | 12/1990 | Smith . |
| 4,991,354 | 2/1991 | Schweickhardt . |
| 5,127,391 | 7/1992 | O'Keefe . |
| 5,179,806 | 1/1993 | Brown et al. . |
| 5,331,743 | 7/1994 | Lump . |
| 5,398,458 | 3/1995 | Henriksen et al. . |
| 5,482,026 | 1/1996 | Russell . |
| 5,542,325 | 8/1996 | Bane, III . |
| 5,605,141 | 2/1997 | Bilotta . |

*Primary Examiner*—Darris Holt Banks
*Attorney, Agent, or Firm*—Cislo & Thomas LLP

[57] ABSTRACT

A compact tile saw which is especially adaptable for cutting of large-sized tiles wherein the table supporting the tile is movable towards the cutting saw, while at the same time the cutting saw is positionable in one of two positions of either being stationary or in moving in unison towards the table supporting the tile to be cut.

17 Claims, 5 Drawing Sheets

SAW HAVING MOVABLE TABLE AND SAW BLADE

BACKGROUND OF THE INVENTION

1. Field of the Invention

This invention relates to compact saws of the type that are usually used for the cutting of tiles and the like.

In the laying of ceramic tile that is ubiquitous in kitchens and bathrooms, it is necessary for the tile cutter to have an easily transportable and compact cutter by which tile segments may be made as by cutting or the like. The most efficient and workmanlike result that is obtained is by far achieved through a ceramic tile saw, with which this invention is primarily directed. The tile saw is relatively lightweight, is fairly compact, and because of the ability to have the saw and table, mounting the tile to be cut, movable towards and away from each other, the tile saw of the invention is capable of handling relatively large-sized tiles for its size even of the type that would normally be used in entry ways, foyers, and the like, as well as countertops and bathroom walls. Additionally, the tile saw of the invention may function as a regular saw, wherein the saw is fixed and the table moves towards the saw in the usual manner.

2. Description of the Related Art

While the prior art has taught the use of movable tables relative to a saw blade, none of the prior art currently known teaches having the table and saw member move towards each other in unison fashion or, wherein the saw member may be made stationary while the table with the tile to be cut thereon moves towards it.

Furthermore, while ceramic tile and the like saws have been known and are extensively used in the prior art, the tile saws currently available are either very large in order to accommodate large-sized tiles and thus, awkward to carry from job site to job site or involve mechanisms which require the utilization of both hands of the operator: one operating the saw blade to move it across the tile while the other hand holds the tile to be cut. With the herein disclosed invention, both hands of the operator may be used to move the tile supporting table, thus decreasing the possible occurrence of hazardous accidents.

Additionally, the prior art devices have suffered in the manner in which mechanical linkage of the movable table has been made with respect to the frame or support structure therefor. That is, generally speaking, the mounting mechanism after a certain amount of wear and tear, does not allow for the accurate guiding of table to the saw blade thusly, not obtaining true and accurate cuts so that recutting is often times necessary. With the horizontally positioned track and wheel combination of the current tile saw, this side to side "slop" is substantially negated and also, allows for easy relative movement by reason of similar mounting of the table of the saw and table towards each other to accomplish the desiratum of a compact tile saw cutter.

The prior art consists of the following:

| U.S. PAT. NO. | INVENTOR | ISSUED |
|---|---|---|
| 2,241,142 | KVALHEIM | MAY 06, 1941 |
| 3,090,615 | MAY | MAY 21. 1963 |
| 3,807,095 | HARDING | APR 30, 1974 |
| 3,844,269 | RATER | OCT 29, 1974 |
| 4,105,012 | HINI | AUG 08, 1978 |

-continued

| U.S. PAT. NO. | INVENTOR | ISSUED |
|---|---|---|
| 4,393,450 | JERARD | JUL 12, 1983 |
| 4,940,038 | O'KEEFE | JUL 10, 1990 |
| 4,976,251 | SMITH | DEC 11, 1990 |
| 4,991,354 | SCHWEICKHARDT | FEB 12, 1991 |
| 5,127,391 | O'KEEFE | JUL 07, 1992 |
| 5,179,806 | BROWN | JAN 19, 1993 |
| 5,331,743 | LUMP | JUL 26, 1994 |
| 5,398,458 | HENRIKSEN | MAR 21, 1995 |
| 5,482,026 | RUSSELL | JAN 09, 1996 |
| 5,542,325 | BANE, III | AUG 06, 1996 |
| 5,605,141 | BILOTTA | FEB 25, 1997 |

DISCLOSURE OF THE INVENTION

The invention relates to a compact, easily carried saw comprising the combination of a frame means, having a pair of opposed, elongate rail members, a saw blade means operatively mounted on said elongate rail members for one of a selected position, comprising stationary and linearly movable; a table member operatively mounted on said frame means for linear movement towards and away from said saw blade means, and means adapted to coordinate unison of movement of said saw blade means when in said linearly movable position with said table member. Additionally, the elongate rail members have upper and lower tracks for cooperative engagement of the saw blade means and the table member so that the same may move relative to each other. To accommodate even larger tiles, the saw blade means is mounted to the frame means by an unshaped bracket support that projects outboard or outwardly of the central longitudinal axis of the frame means. The table member may also be mounted for rotatable movement relative to the saw blade means.

It is an object of the invention to provide a compact, easily carried saw for cutting of ceramic tile which is relatively lightweight and which does not take up much space with respect to its overall dimensions.

It is another important object of the invention to provide a compact tile saw for accommodation of large tiles, wherein the saw blade mechanism is either positionable in a fixed position relative to its support or in a movable position to move towards and away from a table which mounts the tile to be cut, which is similarly mounted.

It is another important object of the invention to provide a compact tile saw wherein the saw blade means and table member supporting the tile to be cut are mounted for movement towards and away from each other in unison by reason of a pulley system.

It is still another object of the invention to provide a compact tile saw wherein a frame member has dual or upper and lower tracks and wherein the saw blade means and the table member are mounted on rollers adapted to be cooperatively guided in a horizontal fashion for linear movement with respect to each other.

It is still a specific object of the invention to provide a compact saw blade means wherein the same is movably mounted on a frame as is a table member and wherein, the saw blade means is supported in cutting position by means of an outboard support bracket to further accommodate large-sized tiles.

It is still a more specific object of the invention to provide a relatively compact, easily carried tile saw, which is capable of accommodating very large tiles for its size and to be able to cut the tiles with a high degree of precision not usually associated with tile cutters of its size.

These and other important objects of the invention will become more apparent from the hereinafter following commentary taken in conjunction with the drawings.

DESCRIPTION OF THE PREFERRED EMBODIMENT(S)

Figure 1:
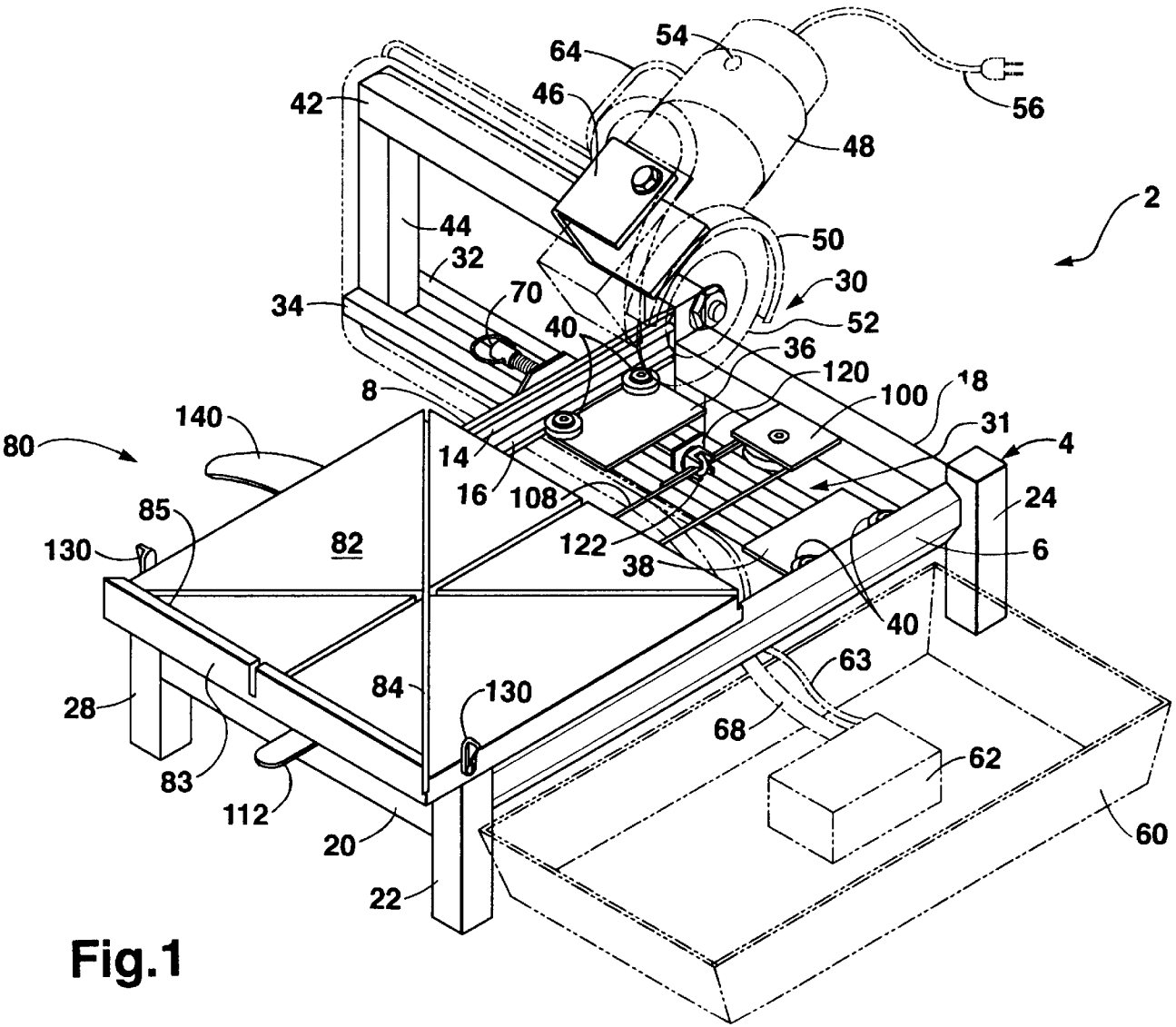
FIG. 1 is a perspective view of the compact tile saw of the invention with lubricant pan, lubricant pump and associated fluid supply and power lines being shown in phantom line.

Referring to the drawings wherein like numerals of reference designate like elements throughout, it will be seen that the compact tile saw 2 of the invention comprises basic frame means 4 in this instance consisting of two opposed, elongate, parallel members 6 and 8, having what may be considered upper track 10 and lower track 12 on elongate rail 6 and upper rail 14 and lower rail 16 on elongate member 8 for purposes to be described.

It will be noted that opposed bar members 18 and 20 complete the frame means 4 which is characterized as having a rectangular configuration with the short ends 18 and 20 providing rigidity and terminating in foot members 22, 24, 26 and 28, thereby forming a raised frame means 4, which may sit upon a counter or floor where the tile saw 2 is to be utilized.

Secured to side rails 6 and 8 in cooperative relationship therewith is saw blade means 30, mounted on carriage means 31, comprising crossed bar members 32 and 34 to which are secured plates 36 and 38, mounting rolling wheels 40 in secure relationship to lower track 12 to thereby allow saw means 30 to move linearly towards and away from the end of frame means 4 and, more specifically, cross-bar member 20, and the table that will support the tile, as will be described.

Cross-bars 32 and 34 extend outward or outboard of the elongate side rail member 8 and has a u-shaped configuration formed by upper bar 42, center bar 44, which is welded or otherwise secured to the extending bars 32 and 34. The terminus of upper bar 42 terminates in motor bracket 46 which is adapted to retain motor 48 having sawguard 50 and circular saw blade 52 in association therewith and being secured in rigid relationship with respect to motor bracket 46. Motor 48 has typical on and off switch 54 with electrical power supply cord 56.

Positioned beneath frame means 4 is rectangular lubricant pan 60 suitable to contain lubricant, such as water, which is pumped by submersible pump 62 via lubricant supply tube 63 to the cutting surface of the tile not shown and at the contact point of the tile with saw blade 52 which not only lubricates the saw blade 52, but also cuts down on the dust associated with sawing through a ceramic tile, as those in the art will well recognize. Power cord 64 runs along with hose 68, from submersible pump 62 to motor 48 by which power is supplied.

Locking pin 70 cooperates with spaced holes 72 in side rail member 8 to enable the saw blade means 30 and, more specifically, the carriage means 31 which mounts the saw blade means 30 on the lower track 12 to be moved in a longitudinal manner along the longitudinal axis of frame means 4 and to rigidly position the saw blade means 30 in a stationary position, as will be described.

Locking pin 70 is spring-biased so that it is urged into a locked position with one of the selected apertures 70, and merely pulling on the ring 74 causes disengagement of the locking pin 70, and rotation thereof keeps the pin 70 in the disengaged position. Situated opposite the saw means 30 is table assembly 80, comprising a platten or table 82, having grooves 84 for purposes well known in the art and wherein, table assembly 80 comprises a carriage system similar to that previously discussed for the saw means 30 and, in this particular instance, consisting of rectangular plates 86 and 88 having horizontally mounted pulley wheels 90, and engaging the upper track 10 of rails 6 and 8, so that the table assembly 80 is linearly movable towards and away from the saw means 30. The platten or table 82 which forms a support surface for a tile (not shown) to be cut is mounted on what may be considered swivel plate assembly 90, comprising opposed plates 92 and 94, and having ball bearings there between, such that the table 82 may be freely rotatable through 360° relative to the table assembly 80, to which it is connected. Obviously, other means of supporting the table 82 would suffice as well, and in its simplest form, it will be contemplated that a simple stud or post pivot be utilized to support the table 82 in rotative fashion within table assembly 80, thereby dispensing with the more complicated and costly ball bearing mechanism in the assembly as shown.

Proximate the mid-section of cross bars 18 and 20, are mounted in aligned relationship, via mounting plates 100 and 102, mobibus wheel elements 104 and 106 here taking the configuration of pulley wheels which are mounted for rotational movement with respect to the mounting plates 100 and 102, respectively. A cable, belt, chain or in this particular instance cord, made of high strength nylon for example, 108 forms a mobibus loop through which unison of movement between saw blade means 30 and table assembly 80 is achieved.

Beneath table 82 is positioned locking assembly 110 which in this particular instance comprises lever arm 112 which is pivotally mounted to cam 114, secured to the table assembly and, more specifically, the under carriage thereof, such that rotation of the lever 112 into a full engaging position engages the cam 114 with pulley cord 108 so as to enable table assembly 80 to move should the cord 108 be moved. The rotation of the lever 112 in the opposite direction releases the camming action so as to release any unison of movement between table assembly 80 and the mobibus cord 108, thereby allowing table assembly 80 with a positioned tile thereon for example, to freely move towards and away from saw blade means 30. In this free-moving position, and assuming that the saw blade means 30 is locked in position, as earlier described, the tile saw 2 of this invention acts much like a conventional tile saw, at least with respect to the cutting operation.

However, when the locking pin 70 is disengaged from the aligned corresponding aperture 72, the saw blade means 30 and table assembly 80 now move in unison towards each other, in a linear fashion, by reason of the engagement of the saw blade means 30 having connecting mechanism 120, in this particular instance comprising clamp 122, which clamps in a captive relationship the cord 108 relative to the saw means 30 and, more specifically, to the cross-supporting bars 32 and 34.

Thus, when the camming mechanism for table assembly 80 is disengaged and the locking pin 70 of the saw means 30 is disengaged, the table assembly 80 and the saw means 30 move in unison by reason of being attached to the same mobibus cord 108 so that movement of the table assembly 80 in direction of the saw means 30 causes translation of movement of the saw blade means 30 towards table 82 and vice versa. However, in practice, once a tile is placed on the table support formed by table 82, the tile setter will push the table and, more specifically, the end 83, having an upstanding ridge 85 by which to confine the tile towards the saw means 30 to thereby engage the saw blade 52 with the ceramic tile to cut the same. Obviously, in the position shown for table 82, longitudinal cuts of a ceramic tile, for example, are contemplated.

Figure 2:
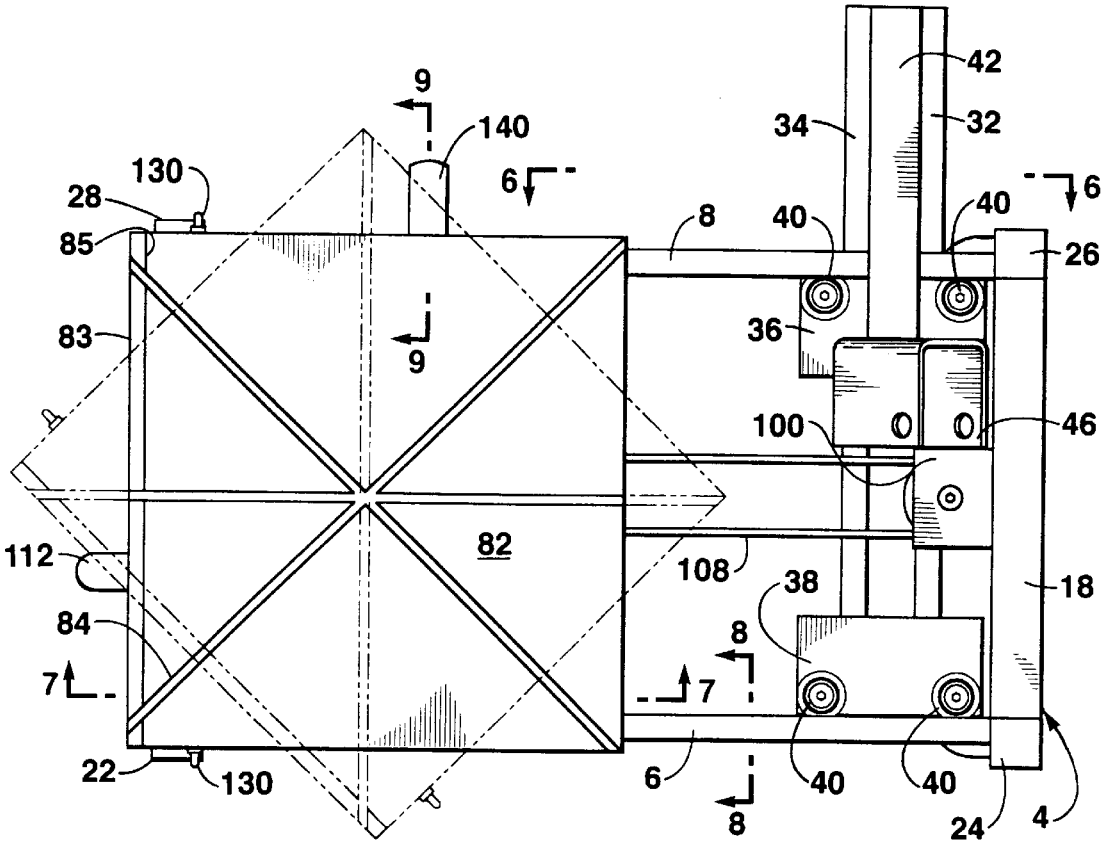
FIG. 2 is a top view of the compact tile saw of the invention but with the saw motor and associated lubricant pump and power lines removed for purposes of clarity.
Figure 3:
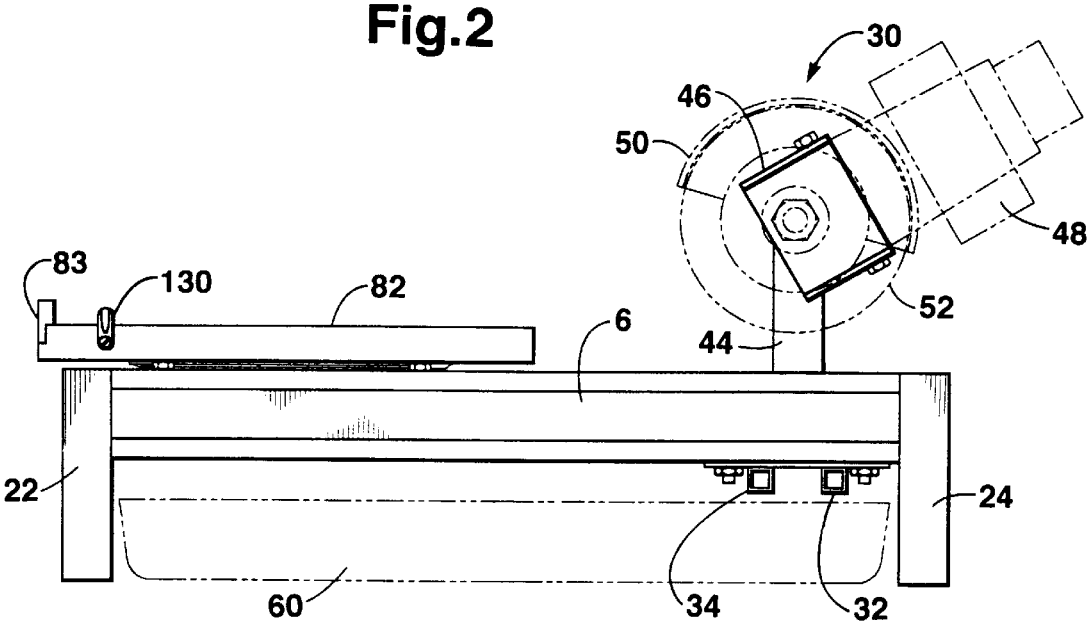
FIG. 3 is a side view of the compact tile saw shown in FIG. 1, with the saw assembly as well lubricant pan being shown in dotted line.
Figure 5:
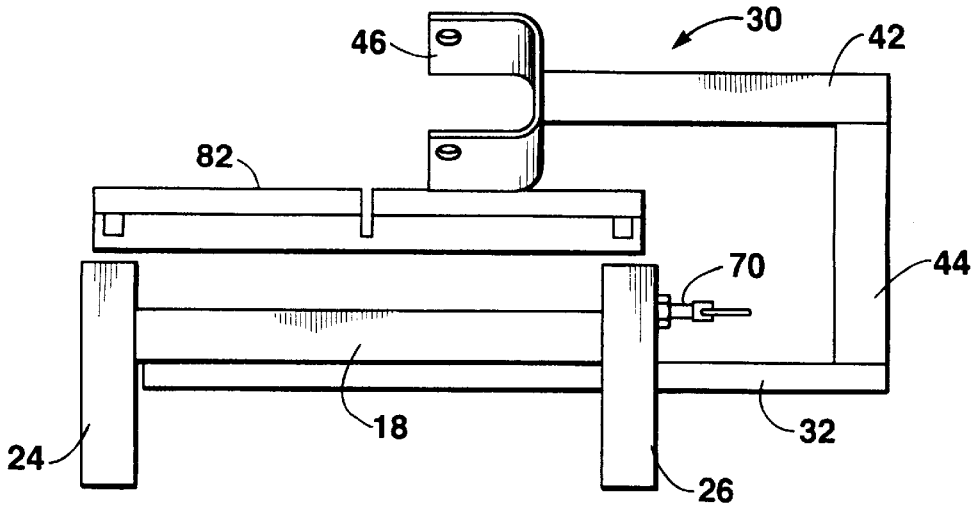
FIG. 5 is an end view of the compact tile saw shown in FIG. 2, again with the motor, lubricant pan, and water pump removed for purposes of clarity.
Figure 4:
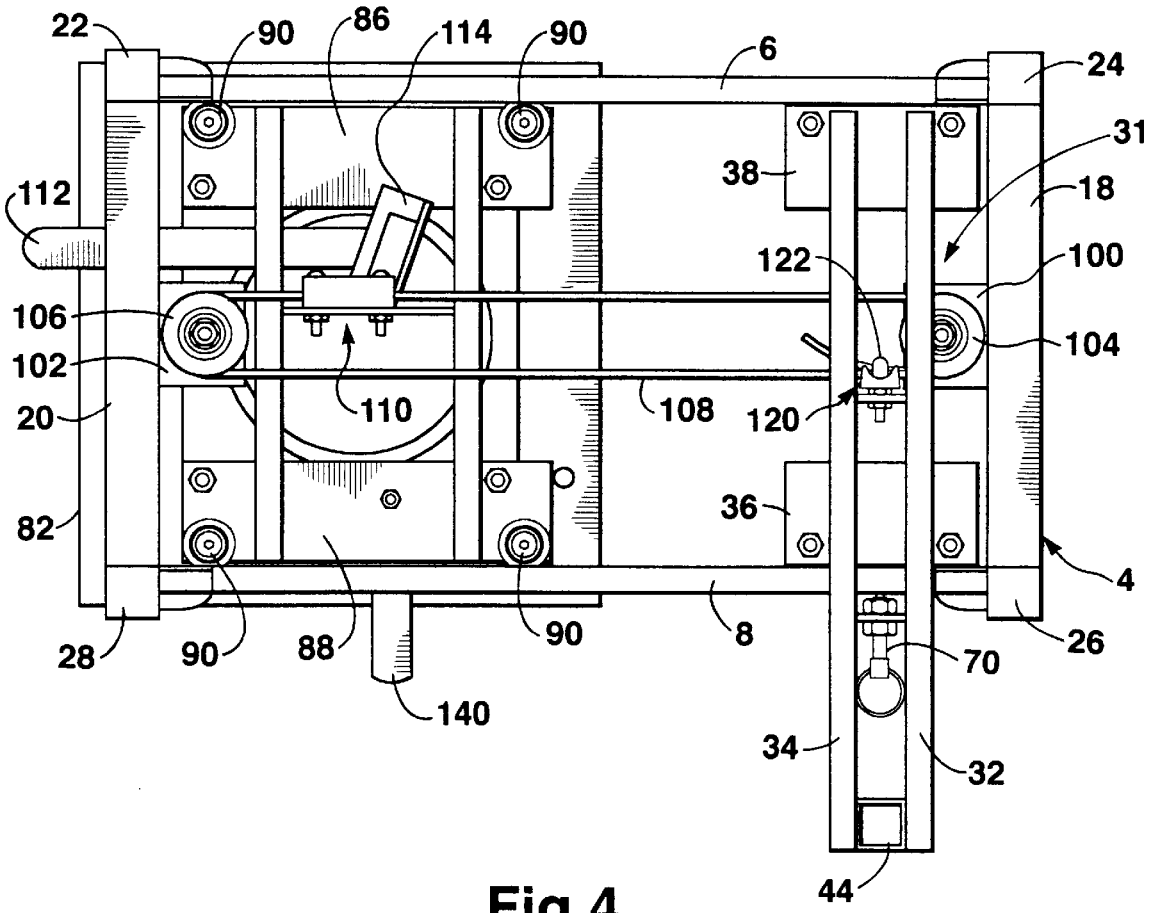
FIG. 4 is a bottom view of the compact tile saw shown in FIG. 2, showing more specific elements of construction thereof.
Figure 6:
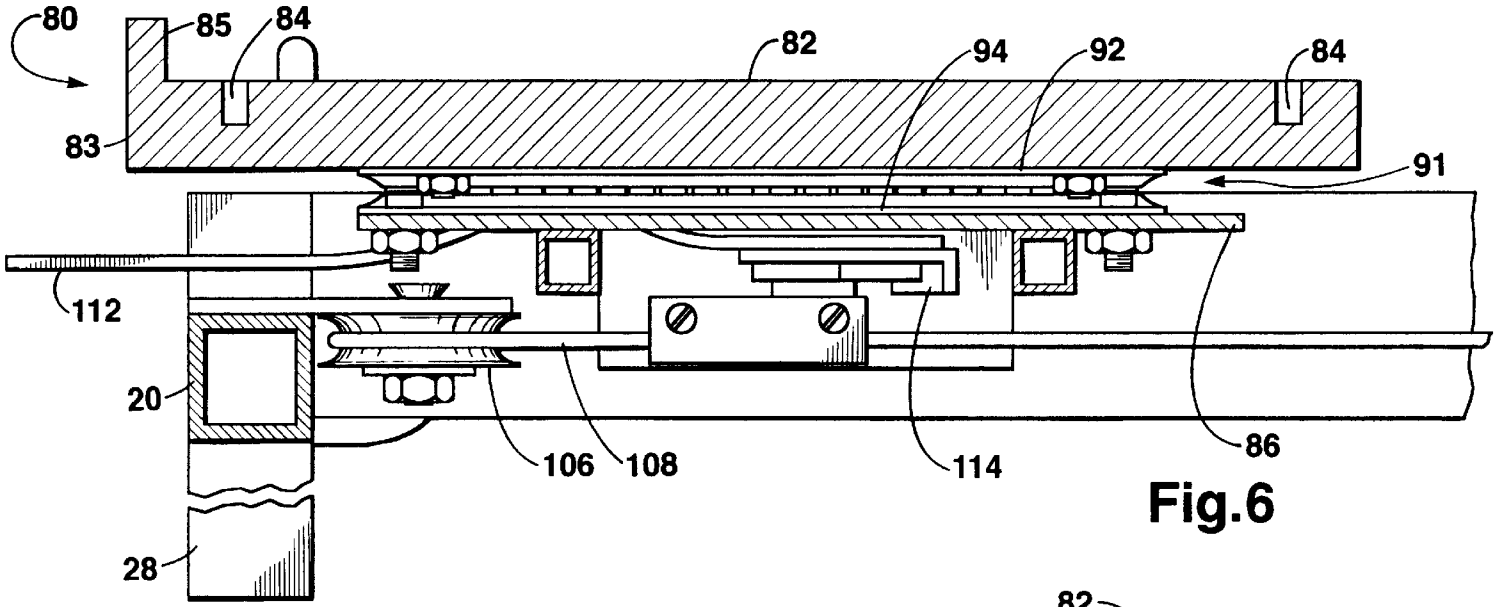
FIG. 6 is a view taken along the line 6—6 of FIG. 2.
Figure 7:
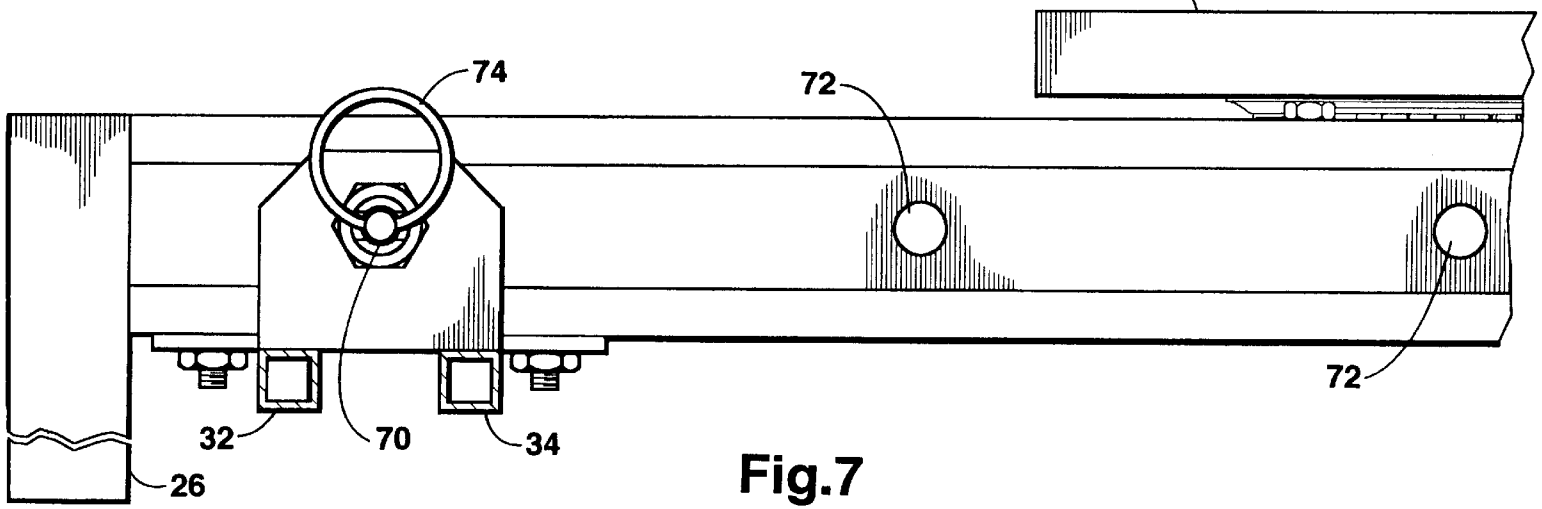
FIG. 7 is a view taken along the line 7—7 of FIG. 2.
Figure 8:
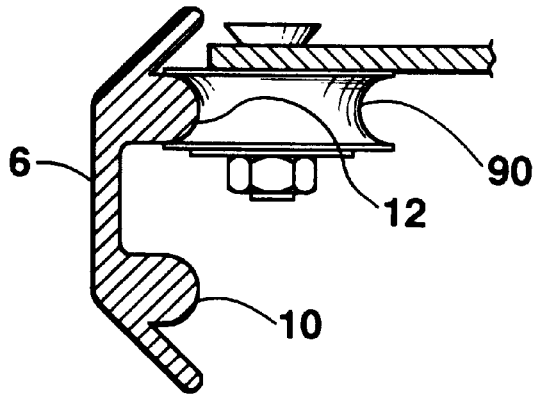
FIG. 8 is a view taken along the line 8—8 of FIG. 2.
Figure 9:
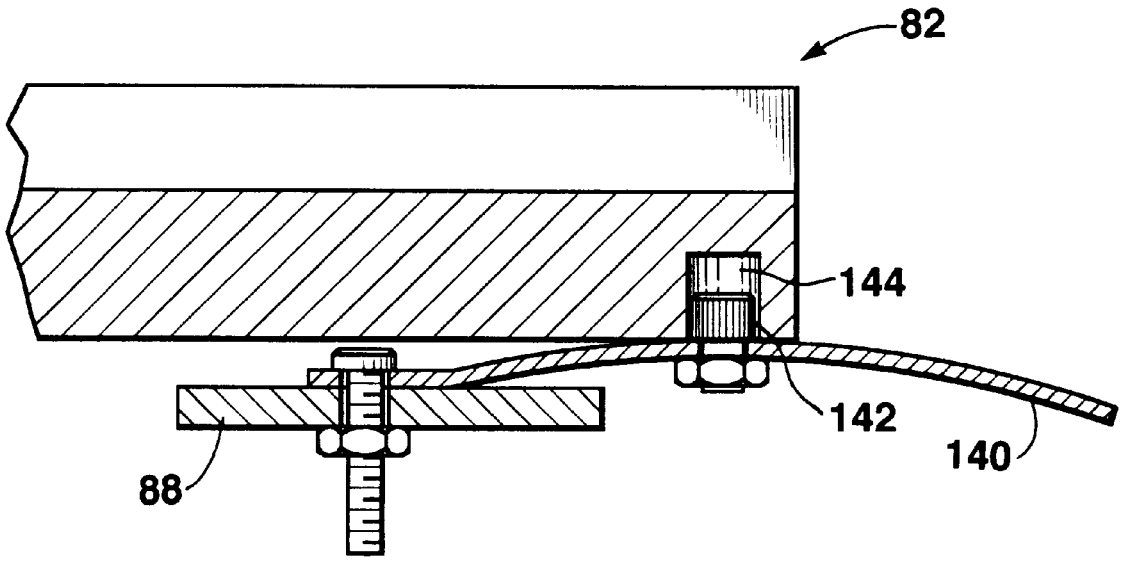
FIG. 9 is a view taken along the line 9—9 of FIG. 2.

However, in order to accommodate cutting on a diagonal, for example, there are positioned on either end of table 82, rotatable stops 130, which may be rotated into upstanding position as shown in FIG. 1, in order to lend greater support, edge wise, for a tile that would be configured to be received within the confines of the upstanding supports 130. Obviously, where a larger tile is contemplated, the upstanding supports 130, would be rotated in a downward position so as to lie below the plane of table 82 to accommodate larger sized tiles. Additionally, in order to obtain diagonal cuts, for example, or to accommodate other types of cuts and larger tiles, the table assembly 80 is configured to rotate through 360° circle, as previously described and, in order to make the table 82 stationary, there is provided spring detent 140, having projecting stub shaft or bolt 142, which projects into one of a plurality of holes 144 formed in the bottom of table 82, to thereby rigidly position table 82, in either the position shown in FIG. 1 or that shown in dotted line in FIG. 2.

EXAMPLE

To test the efficacy of the tile saw cutter of the invention, a structure was built essentially as shown in the drawings, wherein the overall length of the longest part of the cutter 2 or, more specifically, side frames 6 and 8, were approximately 18 inches long, with the width including side rails in the shorter direction or for the supports 18 and 20 being approximately 10 inches in width thereby providing a frame means about 18 inches×10 inches with legs being approximately 4½ inches high. The saw blade means 30 support structure and, more specifically, the u-shaped arm 42 was extending out from rail member 8 about 5½ inches with the vertical support being approximately 5¾ inches high. The table dimensions of table 82 are approximately 10½ inches wide by about 9¾ inches long up to the retaining ridge 85. The motor was of appropriate power and, in this particular instance was one horsepower, capable of 10,000 rpm and adapted to carry a 4½ inch saw blade.

The thusly configured and constructed compact tile saw 2, is not only lightweight for easy carrying but also because of its compact size, is easy to use, for example, in cramped quarters or on countertops when the tile setter, for example, may be laying tile to form a counter. The tile cutter 2 is found to fulfill all the requirements for its size of handling large sized tiles, is convenient and efficient to utilize in that the two hands of the operator, where the saw means is in a stationary position, may be used to move the table 82 towards the stationary saw, and where the saw means 30 is intended to be movable in unison with the table assembly 80, it is found that much larger sized tiles may be cut and worked upon then would be the case if the saw means 30 were stationary.

Thus, there has been disclosed a compact tile saw which is easily handled, of relatively low cost construction, of rigid construction to be relatively fault free in operation, and particularly suited to negate the inaccuracies that would occur by reason for example, of the table and saw being mounted on vertical mounted wheels as opposed to horizontally mounted wheels as disclosed herein.

While specific structures have been shown, it is only important to enjoy the essence of the invention that the table and saw be movable towards and away from each other in unison, and in the manner disclosed. While it is desirable to have horizontal wheels other means may be used, and for that matter mounting inside and on the outside of the rails, as opposed to the upper and lower mounting as disclosed. For example, a singular dual track member may be used to vertically mount wheel or guide members for the saw blade means and table means. Additionally, one may wish to have the saw blade means and table means operatively mounted for unison of movement with no provision for the saw blade means to be stationary. All such modifications and alterations will suggest themselves to those of ordinary skill in the art and all such changes and modifications, as well as others, are intended to be covered by the appended claims.

I claim:

1. A compact saw comprising the combination of:

a frame means having a track member defining a selected plane; a cutting means operatively mounted on said track member for one of a selected position, comprising stationary and linearly movable; a table member operatively mounted on said track member for linear movement towards and away from said cutting means, and means to coordinate unison of movement of said cutting means, when in said linearly movable position, with movement of said table member, said cutting means and said table member being linearly moveable in said selected plane.

2. The saw in accordance with claim 1, wherein said track member comprises opposed, elongate rail members and comprises a double track, having upper and lower tracks wherein said saw blade means is mounted on said lower track and said table member is mounted on said upper track.

3. The saw in accordance with claim 2, wherein said table member is mounted on rollers, said roller s being superposed over the lower track of said elongate rail member cutting means.

4. The saw in accordance with claim 3, wherein said cutting means is mounted on roller members adapted to move along said lower track of said elongate rail members.

5. The saw in accordance with claim 4, wherein said roller members are horizontally aligned with respect to said rail members.

6. The saw in accordance with claim 5, wherein said means adapted to coordinate unison of movement comprises a pulley system, wherein opposed pulley wheels are positioned on opposite ends of said frame means and wherein said table member is selectively locked into and out of position with respect to said pulley system.

7. The saw in accordance with claim 6, where in said pulley system comprises a mobibus member positioned on the said opposed pulley wheels and wherein said cutting means is operatively connected to said mobibus member, and said table member is rotatable with respect to said frame means.

8. The saw in accordance with claim 7, which additionally comprises cross-bars at opposed ends of said frame means forming a rectangular-shaped frame having corners and each of the short ends of said rectangular shaped frame mount opposed pulleys of said pulley system.

9.The saw in accordance with claim 8, wherein said frame means has depending legs at said corners of said rectangular-shaped frame.

10. The saw in accordance with claim 9, wherein said saw blade means is mounted on a u-shaped frame having an extended arm extending outwardly from the longitudinal axis of said frame means.

11. The saw in accordance with claim 10, which includes a lubricant pan operatively positioned beneath said frame means.

12. The saw in accordance with claim 11, which includes a lubricant pump located in said lubricant pan, and means for conducting lubricant from said pan to said blade means.

13. The saw in accordance with claim 12, which additionally includes selected groove lines in said table member.

14. The saw in accordance with claim 13, which includes a locking pin to lock said saw blade means in rigid association with said frame means.

15. A compact saw comprising the combination of:

a frame means defining an elongate track;

a cutting means operatively mounted on said elongate track; said elongate track defining a selected plane a table member operatively mounted on said frame means, said cutting means and said table means being moveable in unison towards and away from each other and means adapted to coordinate the unison of movement of said cutting means and said table means along said selected plane.

16. The saw in accordance with claim 15 which additionally includes stationary means for positioning said saw blade means in a stationary position relative to said table means.

17. A compact tile saw or the like comprising the combination of:

a frame means having opposed, elongate rail members joined at their termini by end bars to thereby form a rectangularly configured frame member having depending legs; each of said elongate rail members having interiorly spaced tracks running the extent thereof;

a saw blade means having an outwardly extending bracket for support of a motorized saw blade and being supported for one of a stationary position and selected movement along said track; a table member for retaining a tile to be cut thereon and being supported on said track for movement towards and away from said saw blade means, and a pulley system centrally spaced of and operatively supported from said frame member and means on said saw blade means to operating associate same with said pulley system, and means on said table member to selectively associate said table means with said pulley system whereby said saw blade means may be securely positioned with respect to said frame member and said table means is guided thereto and alternately, selectively positioned relative to said pulley means to allow synchronous, unison movement of said table and said saw blade means towards and away from each other.

* * * * *